US010747171B2

(12) United States Patent
Sahara

(10) Patent No.: US 10,747,171 B2
(45) Date of Patent: Aug. 18, 2020

(54) IMAGE FORMING APPARATUS WITH A WASTE CONTAINER POSITIONED ON A SIDE OPPOSITE ELECTRICAL CONTACTS AND ROTATIONAL DRIVE RECEIVING PORTIONS

(71) Applicant: CANON KABUSHIKI KAISHA, Tokyo (JP)

(72) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/280,868

(22) Filed: Feb. 20, 2019

(65) Prior Publication Data

US 2019/0265642 A1 Aug. 29, 2019

(30) Foreign Application Priority Data

Feb. 26, 2018 (JP) ..... 2018-032597

(51) Int. Cl.

| | |
|---|---|
| ***G03G 21/18*** | (2006.01) |
| ***G03G 21/12*** | (2006.01) |
| ***G03G 21/10*** | (2006.01) |
| ***G03G 15/00*** | (2006.01) |

(52) U.S. Cl.

CPC ..... *G03G 21/1842* (2013.01); *G03G 15/80* (2013.01); *G03G 21/10* (2013.01); *G03G 21/105* (2013.01); *G03G 21/12* (2013.01); *G03G 21/1814* (2013.01); *G03G 21/1832* (2013.01);

(Continued)

(58) Field of Classification Search

CPC ..... G03G 15/80; G03G 21/0005; G03G 21/0052; G03G 21/10; G03G 21/105; G03G 21/12; G03G 21/1652; G03G 21/1814; G03G 21/1832; G03G 21/1842; G03G 2221/1684; G03G 2221/1869

See application file for complete search history.

(56) References Cited

U.S. PATENT DOCUMENTS

| | | | | |
|---|---|---|---|---|
| 9,423,759 | B2 * | 8/2016 | Sato | G03G 21/0011 |
| 9,519,262 | B1 * | 12/2016 | Tonges | G03G 21/1871 |

FOREIGN PATENT DOCUMENTS

| | | | |
|---|---|---|---|
| JP | 2008052033 | A | 3/2008 |
| JP | 2015118140 | A | 6/2015 |

(Continued)

*Primary Examiner* — Joseph S Wong

(74) *Attorney, Agent, or Firm* — Canon U.S.A., Inc. IP Division

(57) ABSTRACT

An image forming apparatus includes an apparatus main body; a moving unit movable between a first position where the moving unit is inside the apparatus main body and a second position where the moving unit is outside the apparatus main body, the moving unit including an image bearing member, a cleaning member, a conveying member conveying removed toner from the image bearing member, and an outlet disposed at a first end of the moving unit and through which the removed toner is discharged outside the moving unit; a processing unit acting on the image bearing member; and a contact disposed at a second end of the moving unit opposite the first end and through which the processing unit receives power. The apparatus main body includes a container accommodating the removed toner, having an inlet for receiving the removed toner from the outlet.

6 Claims, 8 Drawing Sheets

(52) U.S. Cl.
CPC ..... *G03G 2221/1684* (2013.01); *G03G 2221/1869* (2013.01)

(56) References Cited

FOREIGN PATENT DOCUMENTS

| | | | |
|---|---|---|---|
| JP | 2016033621 | A | 3/2016 |
| JP | 2016194583 | A | 11/2016 |

* cited by examiner

IMAGE FORMING APPARATUS WITH A WASTE CONTAINER POSITIONED ON A SIDE OPPOSITE ELECTRICAL CONTACTS AND ROTATIONAL DRIVE RECEIVING PORTIONS

BACKGROUND OF THE DISCLOSURE

Field of the Disclosure

The disclosure relates to an electrophotographic image forming apparatus having a removable cartridge therein.

Description of the Related Art

Examples of known printers, which are electrophotographic image forming apparatuses, include one that includes a moving member. The moving member is configured to support a plurality of cartridges and capable of being pulled out of an apparatus main body during cartridge replacement (see, e.g., Japanese Patent Laid-Open No. 2016-194583).

Toner left untransferred on a photosensitive drum of each cartridge and removed by a cleaning member is discharged out of the cartridge by a conveying member of the cartridge. For collecting and conveying the removed toner discharged from each of the cartridges to a removed toner container of the apparatus main body, the moving member described above includes a removed toner conveying unit connected to an outlet for the cartridges.

In the configuration disclosed in Japanese Patent Laid-Open No. 2016-194583, an interface between the removed toner conveying unit of the moving member and the removed toner container of the apparatus main body is disposed on the same side as electrical contacts of the moving member for receiving power to be supplied to processing units. Therefore, when the moving member moves, toner may scatter through the interface on the side of the moving member and adhere to the electrical contacts. This may result in poor electrical contact.

SUMMARY OF THE DISCLOSURE

According to an aspect of the disclosure, an image forming apparatus includes an apparatus main body and a moving unit supported by the apparatus main body. The moving unit is movable between a first position in which the moving unit is inside the apparatus main body and a second position in which at least part of the moving unit is exposed outside the apparatus main body. The moving unit includes a rotatable image bearing member; a cleaning member configured to clean the image bearing member; a conveying member configured to convey removed toner in a rotational axis direction of the image bearing member, the removed toner being removed from the image bearing member by the cleaning member; an outlet through which the removed toner conveyed by the conveying member is discharged to the outside of the moving unit, the outlet being disposed at a first end of the moving unit in the rotational axis direction; a processing unit configured to act on the image bearing member, and a contact through which the processing unit receives power from the apparatus main body, the contact being disposed at a second end of the moving unit opposite to the first end in the rotational axis direction. The apparatus main body includes a container configured to accommodate the removed toner therein, the container having an inlet through which the removed toner discharged from the outlet is received, and the container is disposed outside a moving path of the moving unit between the first position and the second position. When the moving unit is at the first position, the inlet is connected to the outlet in such a manner as to receive the removed toner. When the moving unit is at the second position, the inlet is disconnected from the outlet.

Further features and aspects of the disclosure will become apparent from the following description of example embodiments with reference to the attached drawings.

DESCRIPTION OF THE EMBODIMENTS

First Example Embodiment

Figure 2:
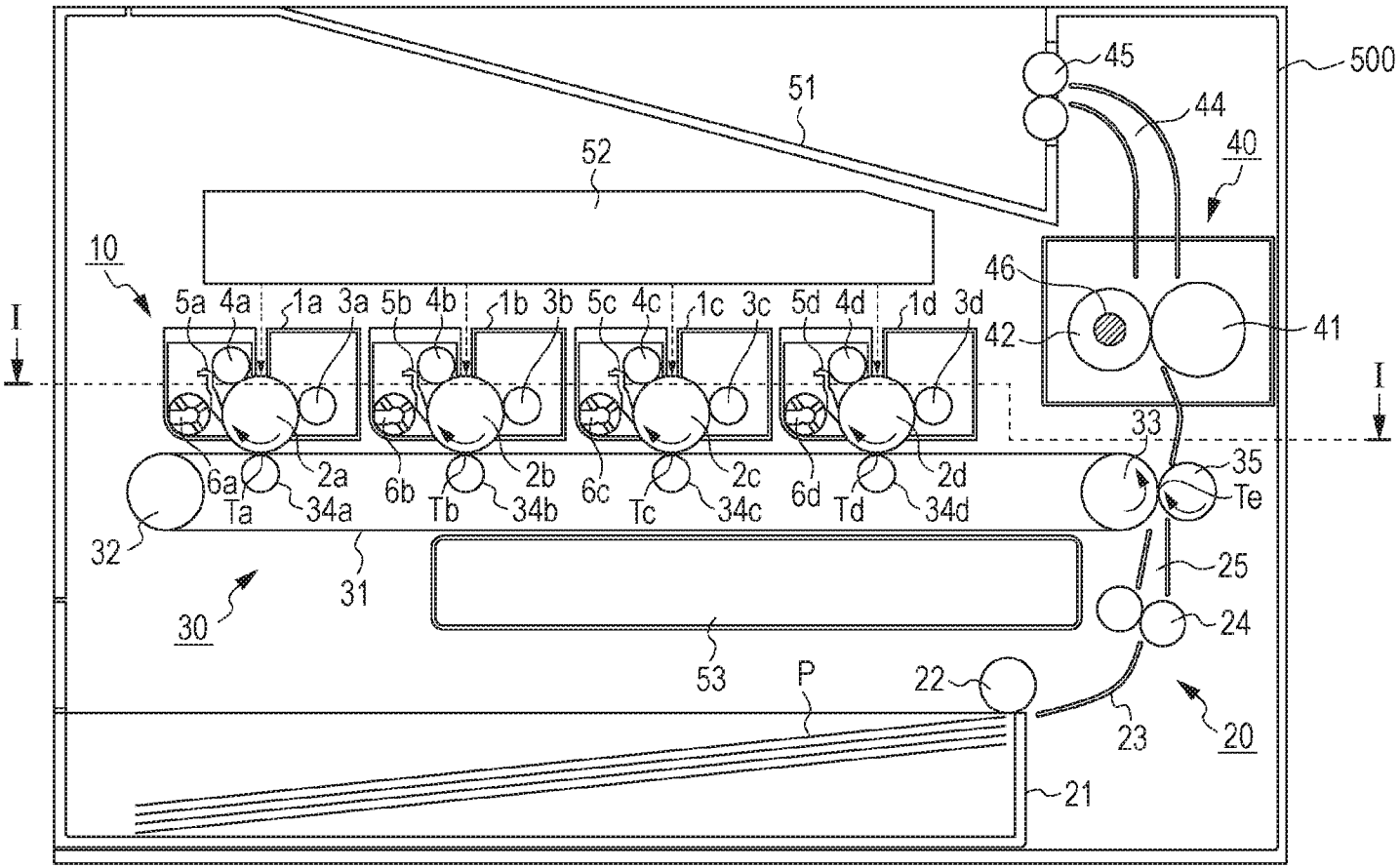
FIG. 2 is a schematic cross-sectional side view of the image forming apparatus according to the first embodiment.

A general configuration of an image forming apparatus according to an example first embodiment of the disclosure will now be described using FIG. 2. The image forming apparatus of the present embodiment is a color image forming apparatus employing an electrophotographic image forming process.

The image forming apparatus includes the following four process cartridges: a process cartridge 1*a* for yellow color, a process cartridge 1*b* for magenta color, a process cartridge 1*c* for cyan color, and a process cartridge 1*d* for black color. Hereinafter, the process cartridge may be simply referred to as a cartridge, and reference numerals "1*a*, 1*b*, 1*c*, and 1*d*" may be written as "1*a* to 1*d*". The cartridges 1*a* to 1*d* will be collectively referred to as a cartridge 10. The cartridges 1*a* to 1*d* are horizontally arranged in a row at regular intervals. Hereinafter, only the cartridge 1*a* will be described in detail and the other cartridges 1*b*, 1*c*, and 1*d*, which have the same configuration as the cartridge 1*a*, will be described only when needed.

The cartridge 1*a* includes a drum-type electrophotographic photosensitive member (hereinafter referred to as "photosensitive drum") 2*a* serving as an image bearing member. The photosensitive drum 2*a* is surrounded by a charging member 4*a* serving as a processing unit that acts on the photosensitive drum 2*a*, a developing member 3*a*, and a cleaning member 5*a*. The cartridge 1*a* further includes a first conveying screw 6*a* disposed near the cleaning member 5*a*. The cartridges 1*b*, 1*c*, and 1*d* similarly include first conveying screws 6*b*, 6*c*, and 6*d*, respectively. An exposure device 52 is disposed above the cartridges 1*a* to 1*d*. The developing members 3*a*, 3*b*, 3*c*, and 3*d* are surrounded by toners of yellow, magenta, cyan, and black, respectively.

The photosensitive drum 2*a* is a negatively-charged organic photoconductor (OPC) which includes an aluminum drum base and a photoconductive layer thereon. The photosensitive drum 2*a* is rotationally driven by a driving device (not shown) in the direction of arrow in FIG. 2 (clockwise) at a predetermined processing speed. The charging member 4*a* uniformly charges the surface of the photosensitive drum 2*a* to a predetermined negative potential with a charging bias applied from a charging bias power supply (not shown). The developing member 3*a* causes toner of the corresponding color (yellow) to adhere to an electrostatic latent image formed on the photosensitive drum 2*a*, and thereby develops (or makes visible) the electrostatic latent image to produce a toner image. Examples of the developing method used by the developing member 3*a* include a two-component contact developing method in which a developing agent obtained by mixing a magnetic carrier with toner particles is conveyed by magnetic force and brought into contact with the photosensitive drum 2*a* to develop the electrostatic latent image thereon.

Primary transfer rollers 34*a*, 34*b*, 34*c*, and 34*d*, each serving as a transfer unit, are elastic members. At primary transfer portions Ta, Tb, Tc, and Td, the primary transfer rollers 34*a*, 34*b*, 34*c*, and 34*d* are in contact with the photosensitive drums 2*a*, 2*b*, 2*c*, and 2*d*, respectively, with an endless intermediate transfer belt 31 interposed therebetween. Although the primary transfer rollers 34*a* to 34*d* are used as transfer units here, they may be replaced by transfer blades. In this case, when a toner image is transferred onto the intermediate transfer belt 31, such a transfer blade is brought into contact with the intermediate transfer belt 31 by a high voltage applied thereto.

The cleaning member 5*a* removes toner which is left untransferred on the surface of the photosensitive drum 2*a*. The removed toner is conveyed by the first conveying screw (first conveying member) 6*a* to the outside of the cartridge 1*a*.

The exposure device 52 exposes the surface of the photosensitive drum 2*a* to laser light by using, for example, a polygonal mirror (not shown) rotating at high speed. The laser light is modulated in accordance with a time-series electric digital pixel signal corresponding to image information, and is output from a laser output unit (not shown). The exposure device 52 then produces an electrostatic latent image of color (yellow) in accordance with the image information, on the surface of the photosensitive drum 2*a* charged by the charging member 4*a*.

A paper feed unit 20 includes a paper feed cassette 21, a cassette paper feed roller 22, a conveying guide 23, a registration roller pair 24, and a pre-transfer guide 25. By the paper feed unit 20, recording materials P in the paper feed cassette 21 are each conveyed to a secondary transfer portion Te.

An intermediate transfer unit 30 includes the intermediate transfer belt 31 extending between a driving roller 33 and a tension roller 32. The intermediate transfer belt 31 is driven by the driving roller 33 to move in the direction of arrow in FIG. 2 (counterclockwise). The intermediate transfer belt 31 is a dielectric resin film, such as a polycarbonate resin film, a polyethylene terephthalate resin film, or a polyvinylidene fluoride resin film.

A fixing unit 40 that includes a fixing roller 42 having an internal heat source 46 and a pressure roller 41 is disposed downstream of the secondary transfer portion Te. A discharge conveying guide 44 and a discharge roller pair 45 are disposed downstream of the fixing unit 40 in the paper running direction. A paper output tray 51 for holding thereon the recording materials P discharged by the discharge roller pair 45 is disposed downstream of the discharge roller pair 45 in the paper running direction, at the top of the image forming apparatus.

An image forming operation performed by the image forming apparatus will now be described. In response to a signal for starting image formation, the photosensitive drums 2*a* to 2*d* of the cartridges 1*a* to 1*d*, which are rotationally driven at a predetermined processing speed, are uniformly negatively charged by the charging members 4*a* to 4*d*. The exposure device 52 causes the laser output unit (not shown) to convert image signals of an output image into optical signals. The exposure device 52 then exposes the photosensitive drums 2*a* to 2*d* to the resulting optical signals (laser light), which are scanned over the photosensitive drums 2*a* to 2*d*, to produce electrostatic latent images.

Then first, the developing member 3*a* applied with a developing bias of the same charging polarity as that of the photosensitive drum 2*a* (i.e., negative developing bias) causes yellow toner to adhere to the electrostatic latent image formed on the photosensitive drum 2*a* to produce a visible toner image. Then, at the primary transfer portion Ta, the yellow toner image is transferred onto the intermediate transfer belt 31 by the primary transfer roller 34*a* applied with a transfer bias of the polarity opposite that of the toner.

The portion of the intermediate transfer belt 31 to which the yellow toner image is transferred is moved by the driving roller 33 toward the cartridge 1*b*. At the primary transfer portion Tb formed by the cartridge 1*b* and the primary transfer roller 34*b*, a magenta toner image formed on the photosensitive drum 2*b* in the same manner as above is superimposed and transferred onto the yellow toner image on the intermediate transfer belt 31. Similarly, cyan and black toner images formed on the photosensitive drums 2*c* and 2*d* of the cartridges 1*c* and 1*d* are sequentially superimposed at the primary transfer portions Tc and Td onto the yellow and magenta toner images on the intermediate transfer belt 31. Then, a full-color toner image obtained by superimposing the toner images of multiple colors is formed on the intermediate transfer belt 31.

When the leading edge of the toner image on the intermediate transfer belt 31 reaches the secondary transfer portion Te, the recording material P fed from the paper feed cassette 21 is conveyed to the secondary transfer portion Te by the registration roller pair 24. Then, at the secondary transfer portion Te, the full-color toner image is transferred onto the recording material P by a secondary transfer roller 35 applied with a transfer bias of polarity opposite that of the toner.

The recording material P having the toner image formed thereon is conveyed to the fixing unit 40, subjected to heat and pressure at the fixing nip between the fixing roller 42 and the pressure roller 41, and fixed onto the recording material P. After the fixing process, the recording material P is discharged by the discharge roller pair 45 onto the paper output tray 51 at the top of the apparatus. This completes the series of image forming steps.

Figure 1:
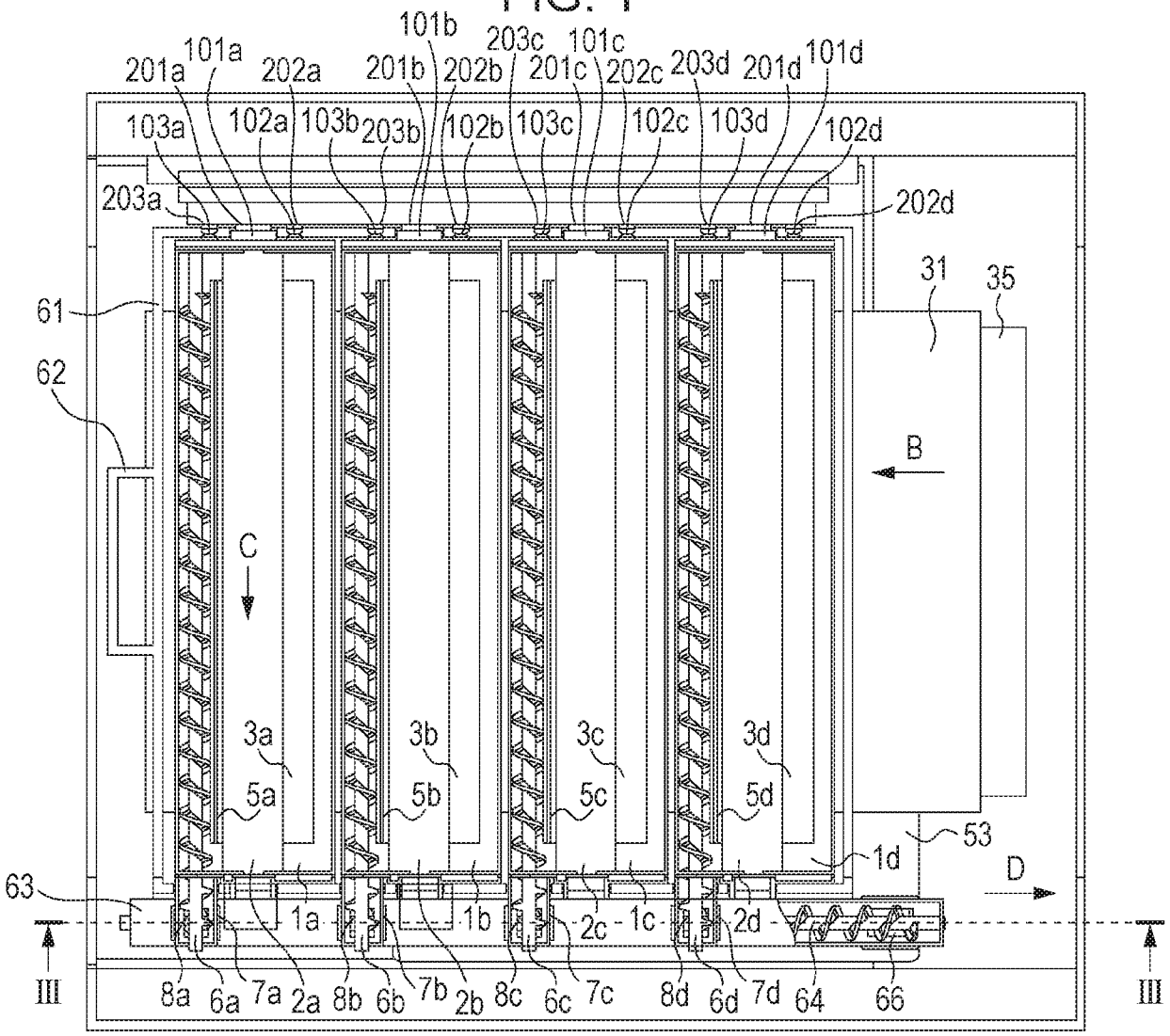
FIG. 1 is a schematic cross-sectional view of an image forming apparatus according to an example first embodiment, as viewed from above in a vertical direction.
Figure 3:
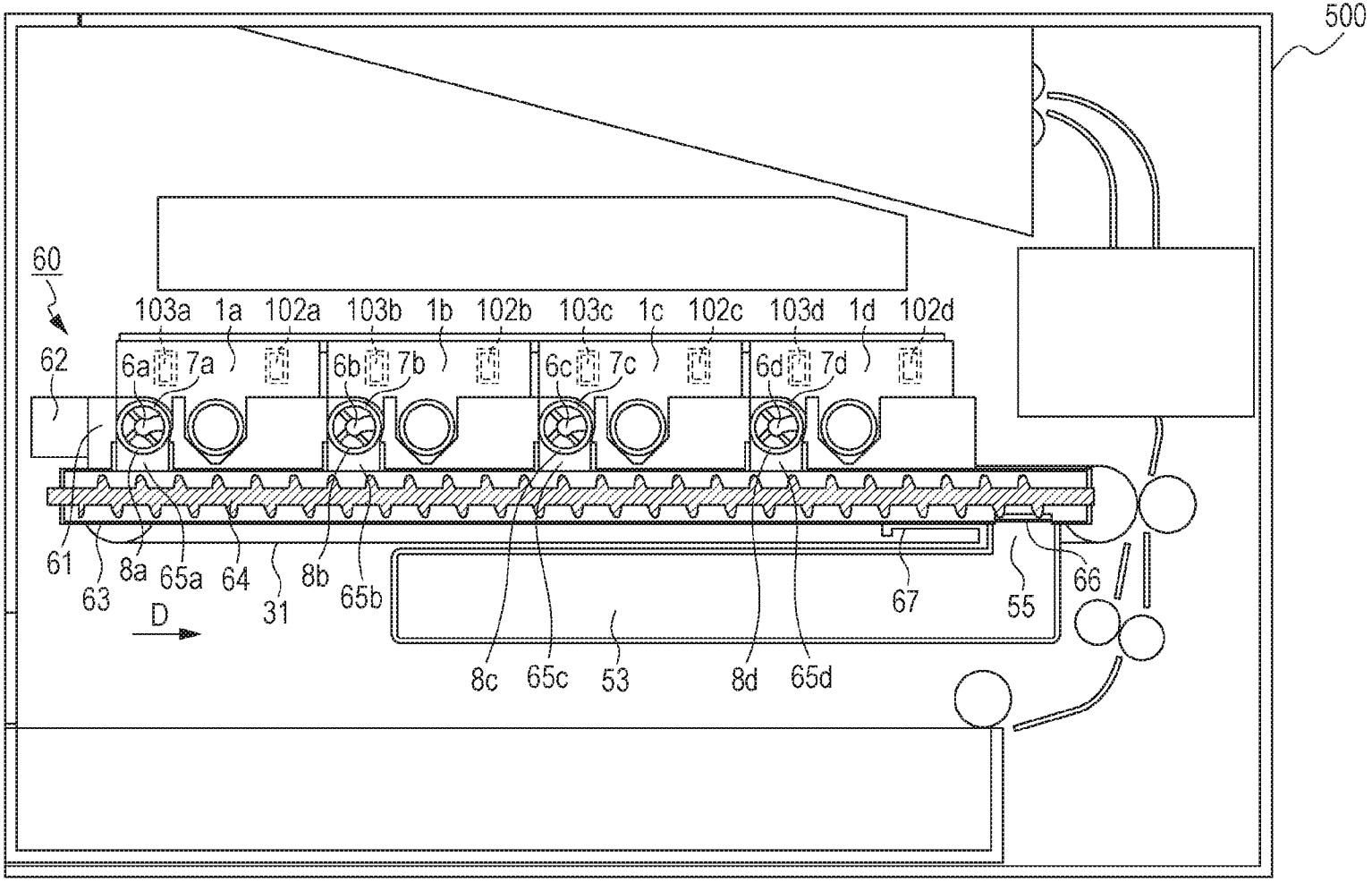
FIG. 3 is another schematic cross-sectional side view of the image forming apparatus according to the first embodiment.
Figure 4A:
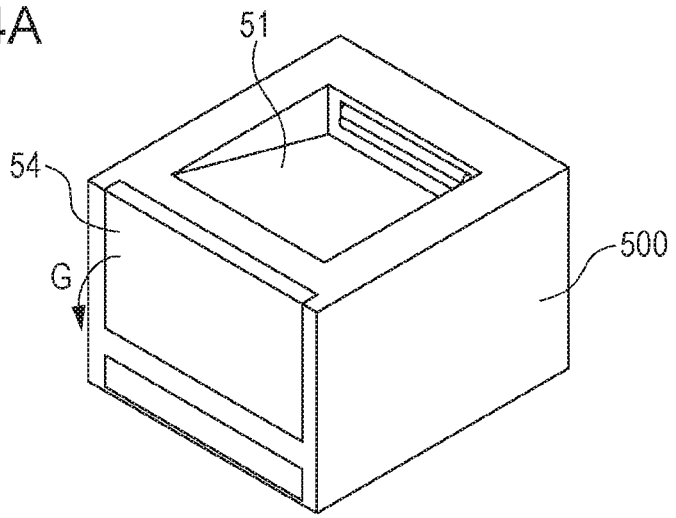
FIG. 4A is a perspective view of an image forming apparatus according to an embodiment, with an opening and closing door closed.
Figure 4B:
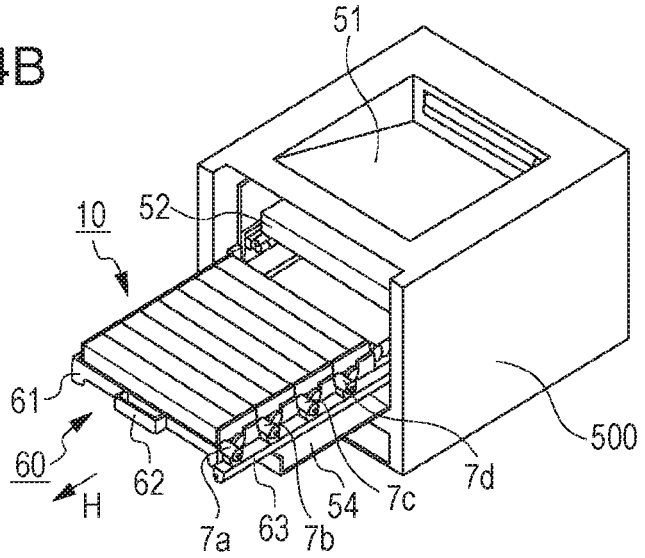
FIG. 4B is a perspective view of the image forming apparatus, with the opening and closing door open.
Figure 4C:
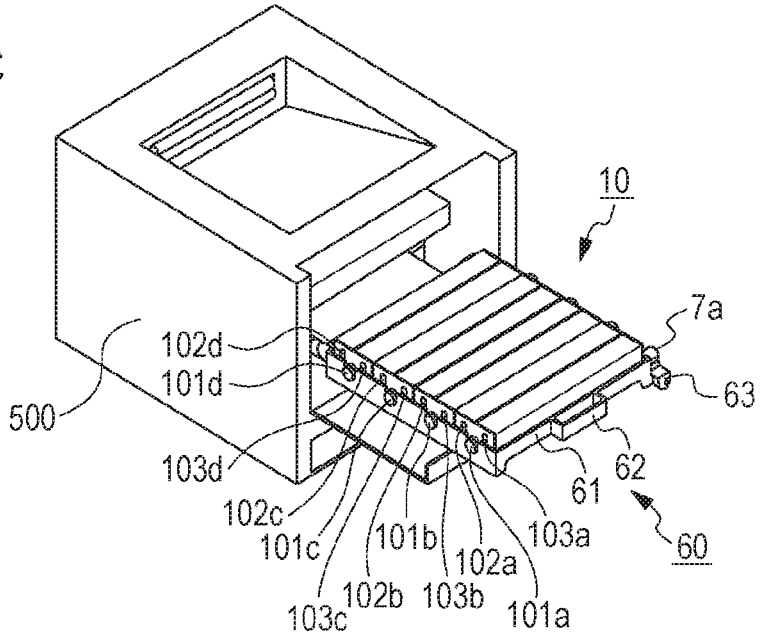
FIG. 4C is a perspective view of the image forming apparatus, as viewed in a direction different from that in FIG. 4B.

Characteristic features of the present embodiment will now be described using FIG. 1, FIG. 3, and FIGS. 4A to 4C. FIG. 1 is a cross-sectional view taken along line I-I of FIG. 2. FIG. 1 schematically illustrates the image forming apparatus of the present embodiment, as viewed from above. FIG. 3 is a cross-sectional view taken along line III-III of FIG. 1. FIG. 4A is a perspective view of the image forming apparatus, with an opening and closing door (opening and closing member) 54 closed. FIG. 4B is a perspective view of the image forming apparatus in which the opening and closing door 54 opens to allow a moving member (moving unit) 60 to be pulled out of an apparatus main body 500. FIG. 4C is a perspective view of the image forming apparatus in which the opening and closing door 54 opens to allow the moving member 60 to be pulled out of the apparatus main body 500, as viewed from an angle different from that in FIG. 4B.

As illustrated in FIG. 1, the cartridges 1*a* to 1*d* are arranged side by side in the running direction of the intermediate transfer belt 31 (i.e., in the direction of arrow B). The cartridge 1*a* includes therein the photosensitive drum 2*a* and the first conveying screw 6*a* extending in the longitudinal direction (i.e., rotational axis direction) of the photosensitive drum 2*a*. The photosensitive drum 2*a* and the first conveying screw 6*a* are both rotationally driven by a driving source (not shown). By the first conveying screw 6*a*, toner removed from the surface of the photosensitive drum 2*a* by the cleaning member 5*a* is conveyed in the direction of arrow C. The direction of arrow C is along the longitudinal direction of the photosensitive drums 2 (2*a* to 2*d*). The cartridges 1*a*, 1*b*, 1*c*, and 1*d* have, at their respective ends in the longitudinal direction, cylindrical protrusions 7*a*, 7*b*, 7*c*, and 7*d* which include therein the first conveying screws 6*a*, 6*b*, 6*c*, and 6*d*, respectively. The cylindrical protrusions 7*a*, 7*b*, 7*c*, and 7*d* have first removed toner outlets 8*a*, 8*b*, 8*c*, and 8*d*, respectively, which are configured to allow removed toners conveyed by the first conveying screws 6*a*, 6*b*, 6*c*, and 6*d* to be discharged to the outside of the cartridges 1*a*, 1*b*, 1*c*, and 1*d*.

A removed toner conveying unit 63 is disposed below the first removed toner outlets 8*a* to 8*d* in the vertical direction. The removed toner conveying unit 63 includes therein a second conveying screw (second conveying member) 64. The second conveying screw 64 is rotationally driven by a driving source (not shown) to convey the removed toner discharged from the cartridges 1*a* to 1*d* in the direction of arrow D. The direction of arrow D is a direction intersecting the longitudinal direction of the photosensitive drums 2. The removed toner conveying unit 63 has a second removed toner outlet 66 at the most downstream portion thereof in the removed toner conveyance direction. The removed toner conveyed by the second conveying screw 64 is discharged through the second removed toner outlet 66 and collected into a removed toner container 53 of the apparatus main body 500. As illustrated in FIG. 3, the removed toner container 53 has a second removed toner inlet 55 facing the second removed toner outlet 66. The second removed toner outlet 66 and the second removed toner inlet 55 form an interface between the moving member 60 and the apparatus main body 500. The removed toner container 53 is disposed below the removed toner conveying unit 63 in the vertical direction.

As illustrated in FIGS. 3 and 4C, the cartridges 1*a*, 1*b*, 1*c*, and 1*d* have, at their respective ends in the longitudinal direction of the photosensitive drums 2, charging contacts 103*a*, 103*b*, 103*c*, and 103*d*, developing contacts 102*a*, 102*b*, 102*c*, and 102*d*, and drive couplings (drive receiving portions) 101*a*, 101*b*, 101*c*, and 101*d*, respectively. The cartridges 1*a*, 1*b*, 1*c*, and 1*d* also have the first removed toner outlets 8*a*, 8*b*, 8*c*, and 8*d*, respectively, at the respective other ends thereof in the longitudinal direction of the photosensitive drums 2. The charging contacts 103 (103*a*, 103*b*, 103*c*, and 103*d*) are contacts for receiving power supply from charging feed portions 203 (203*a*, 203*b*, 203*c*, and 203*d*) (see FIG. 1) of the apparatus main body 500 for applying a charging bias to the charging members 4 (4*a*, 4*b*, 4*c*, and 4*d*). The developing contacts 102 (102*a*, 102*b*, 102*c*, and 102*d*) are contacts for receiving power supply from developing feed portions 202 (202*a*, 202*b*, 202*c*, and 202*d*) (see FIG. 1) of the apparatus main body 500 for applying a developing bias to the developing members 3 (3*a*, 3*b*, 3*c*, and 3*d*). The drive couplings 101 (101*a*, 101*b*, 101*c*, and 101*d*) are components for receiving a driving force for driving the photosensitive drums 2 (2*a*, 2*b*, 2*c*, and 2*d*) from main body driving portions 201 (201*a*, 201*b*, 201*c*, and 201*d*) (see FIG. 1) of the apparatus main body 500.

In the longitudinal direction of the photosensitive drums 2, the removed toner conveying unit 63 (or second removed toner outlet 66) is disposed at an end of the moving member 60 opposite the end of the cartridge 10 where the charging contacts 103, the developing contacts 102, and the drive couplings 101 are arranged.

A conveyance path for conveying removed toner will now be described using FIG. 3. The moving member 60 includes a supporting frame 61, which removably supports the cartridges 1*a* to 1*d*. The removed toner conveying unit 63 is disposed on a side of the supporting frame 61 extending in a direction intersecting the longitudinal direction of the photosensitive drums 2. The removed toner conveying unit 63 has first removed toner inlets 65*a*, 65*b*, 65*c*, and 65*d* corresponding to the first removed toner outlets 8*a*, 8*b*, 8*c*, and 8*d*, respectively, of the cartridges 1*a*, 1*b*, 1*c*, and 1*d*. The removed toner conveying unit 63 also has the second removed toner outlet 66 and a shutter 67 capable of opening and closing with respect to the second removed toner outlet 66.

The second removed toner outlet 66 is disposed at the most downstream portion of the removed toner conveying unit 63 in the conveyance direction of the first conveying screws 6*a* to 6*d* (i.e., in the direction of arrow D) and faces the second removed toner inlet 55 of the removed toner container 53. The removed toner container 53 is disposed below the intermediate transfer belt 31 of the apparatus main body 500.

Replacing the cartridges 1 will now be described using FIGS. 4A to 4C. The opening and closing door 54 capable of opening and closing in the direction of arrow G is disposed on one side of the apparatus main body 500. FIG. 4A illustrates the image forming apparatus, with the opening and closing door 54 closed. In the state of FIG. 4A, the moving member 60 is positioned in the apparatus main body 500 illustrated in FIGS. 1 to 3, that is, at the position (first position) which enables image formation to take place in the cartridges 1*a* to 1*d*. For cartridge replacement, the opening and closing door 54 is opened in the direction of arrow G. FIGS. 4B and 4C illustrate the image forming apparatus in which the opening and closing door 54 opens to allow the moving member 60 to be pulled out to a maximum extent (i.e., to a second position) in the direction of arrow H. That is, the moving member 60 is configured to be movable between the first position and the second position. The moving member 60 has a handle 62 at an end portion thereof closer to the opening and closing door 54. The user holds the handle 62 to pull out the moving member 60. As illustrated in FIG. 4B, the removed toner conveying unit 63 connected to the cylindrical protrusions 7*a* to 7*d* including therein the first conveying screws 6*a* to 6*d* of the cartridges 1*a* to 1*d* are disposed on a side of the supporting frame 61. The moving member 60 is configured to be able to be pulled out until the cartridge 1*d*, which is at the most upstream position in the direction from the first position to the second position, is exposed outward from the apparatus main body 500. When the moving member 60 is at the first position, the shutter 67 is positioned to open the second removed toner outlet 66, whereas when the moving member 60 is at the second position, the shutter 67 is positioned to close the second removed toner outlet 66. When the moving member 60 is at the first position, the second removed toner inlet 55 is connected to the second removed toner outlet 66 to receive removed toner, whereas when the moving member 60 is at the second position, the second removed toner inlet 55 is disconnected from the second removed toner outlet 66.

The present embodiment can prevent scattering toner from adhering to electrical contacts of the cartridge 10 when the moving member 60 that supports the cartridge 10 is moved. The present embodiment can also prevent toner from adhering to the drive couplings (drive receiving portions) 101 that receive a driving force for driving the photosensitive drums 2 from the apparatus main body 500, and thus can prevent the occurrence of drive transmission error.

The moving member 60 does not necessarily need to be moved in the direction intersecting the longitudinal direction of the photosensitive drums 2. The advantageous effects described above can be achieved even with a configuration in which the moving member 60 is moved in the longitudinal direction of the photosensitive drums 2. The drive couplings (drive receiving portions) 101 arranged at an end of the cartridge 10 in the longitudinal direction do not necessarily need to be on the same side as the electrical contacts, and may be on the same side as the second removed toner outlet 66 of the moving member 60. When the moving member 60 is at the second position, it is only necessary that at least one of the cartridges 1 be exposed outward from the apparatus main body 500.

The removed toner container 53 is disposed in the apparatus main body 500 in such a manner as to allow the moving member 60 to move between the first position and the second position. The removed toner container 53 is disposed outside a moving path of the moving unit between the first position and the second position.

Second Example Embodiment

A configuration of an example second embodiment will now be described using FIG. 5. The configuration of the second embodiment is the same as that of the first embodiment, except for the position of the second removed toner outlet 66 of the removed toner conveying unit 63 and the position of the second removed toner inlet 55 of the removed toner container 53 of the apparatus main body 500. In the second embodiment, therefore, the description of the same configuration as that of the first embodiment will be omitted.

Figure 5:
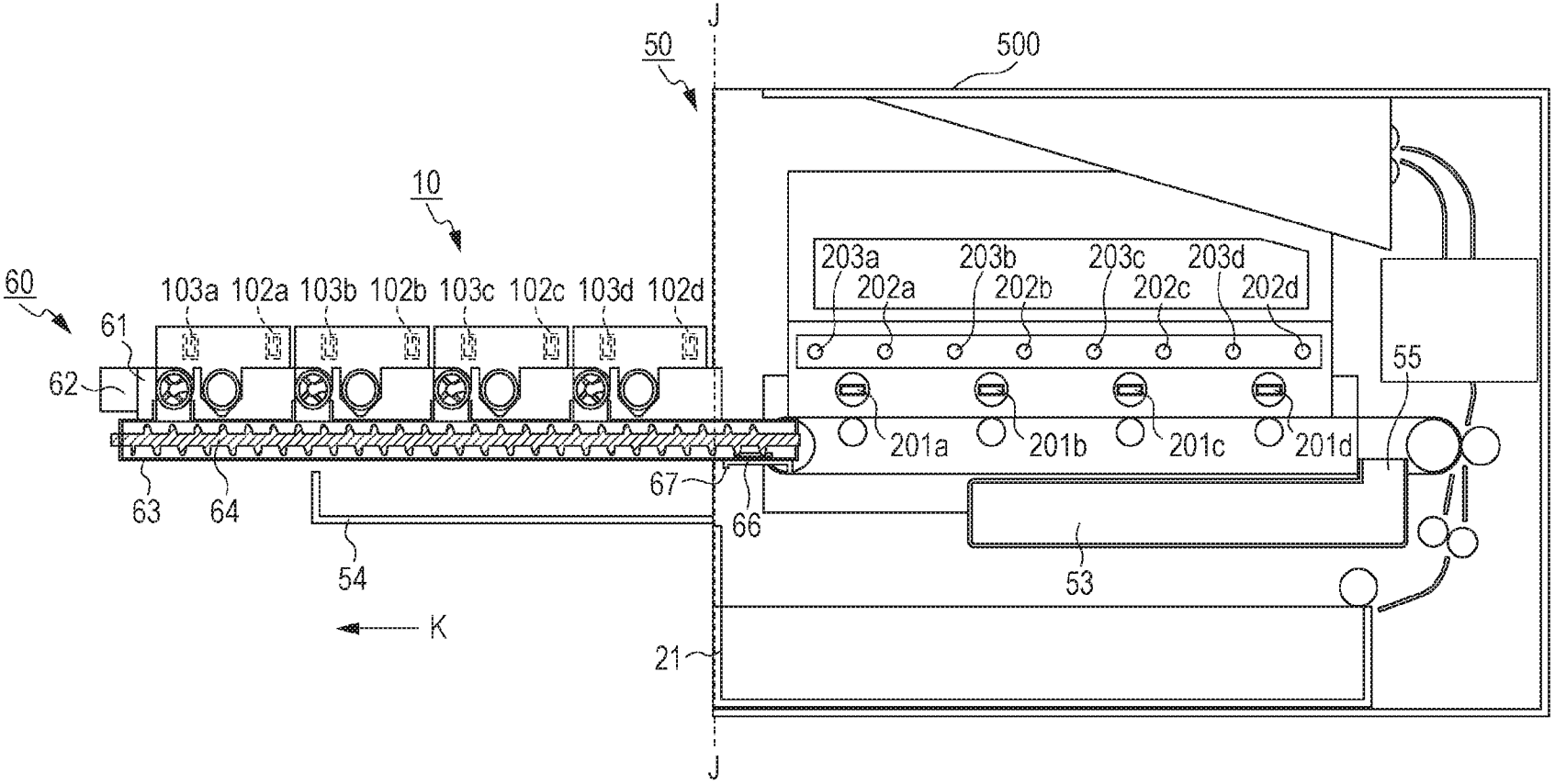
FIG. 5 is a schematic cross-sectional side view of an image forming apparatus according to an example second embodiment.

FIG. 5 is a cross-sectional view taken at the same position as that for FIG. 3. Referring to FIG. 5, the moving member 60 is pulled out of the apparatus main body 500 to a maximum extent (i.e., to the second position) in the direction of arrow K. The direction of arrow K is a direction in which the moving member 60 is moved from the first position to the second position.

The main body driving portion 201*a* in FIG. 5 is disposed in the apparatus main body 500. The main body driving portion 201*a* is engaged with the drive coupling 101*a* (see FIGS. 4A to 4C) of the cartridge 1*a* to transmit a driving force for rotationally driving the photosensitive drum 2*a*. The charging feed portion 203*a* and the developing feed portion 202*a* are disposed in the apparatus main body 500. The charging feed portion 203*a* and the developing feed portion 202*a* are configured to supply power to the charging contact 103*a* and the developing contact 102*a*, respectively.

The position of the second removed toner outlet 66 in the removed toner conveying unit 63 of the moving member 60, which is a feature of the present embodiment, will now be described.

In the longitudinal direction of the photosensitive drums 2, the second removed toner outlet 66 is disposed on a side (or at an end) of the moving member 60 opposite a side (or an end) of the cartridge 10 where the charging contacts 103, the developing contacts 102, and the drive couplings 101 are arranged. This configuration is the same as that of the first embodiment. That is, even when toner scatters through the second removed toner outlet 66 while the moving member 60 is being moved, the scattering toner can be prevented from adhering to the charging contacts 103, the developing contacts 102, and the drive couplings 101.

When the moving member 60 is at the second position, the second removed toner outlet 66 is located inside the apparatus main body 500 with respect to an exterior line J-J. At this point, the shutter 67 is positioned to close the second removed toner outlet 66. Therefore, even when the moving member 60 is moved to the second position for replacing the cartridges 1, toner can be prevented from scattering through the second removed toner outlet 66 to the outside of the apparatus main body 500. Also, when the moving member 60 is at the second position, the cartridge 1*d* disposed at the most upstream position in the direction of arrow K is located outside the apparatus main body 500 with respect to the exterior line J-J. This facilitates replacement of the cartridge 1*d*. Note that the exterior line J-J is a line that extends along an end portion of the apparatus main body 500 in the direction of arrow K and is perpendicular to the direction of arrow K.

The configuration of the present embodiment can thus prevent toner from scattering through the second removed toner outlet 66 of the moving member 60 to the outside of the apparatus main body 500.

Third Example Embodiment

An example third embodiment will now be described using FIG. 6. The present embodiment is the same as the first embodiment, except for an electrical component unit (high-voltage power supply unit) 83, a driving unit 82, and an airflow L. The description of the same configuration as that of the first embodiment will therefore be omitted.

Figure 6:
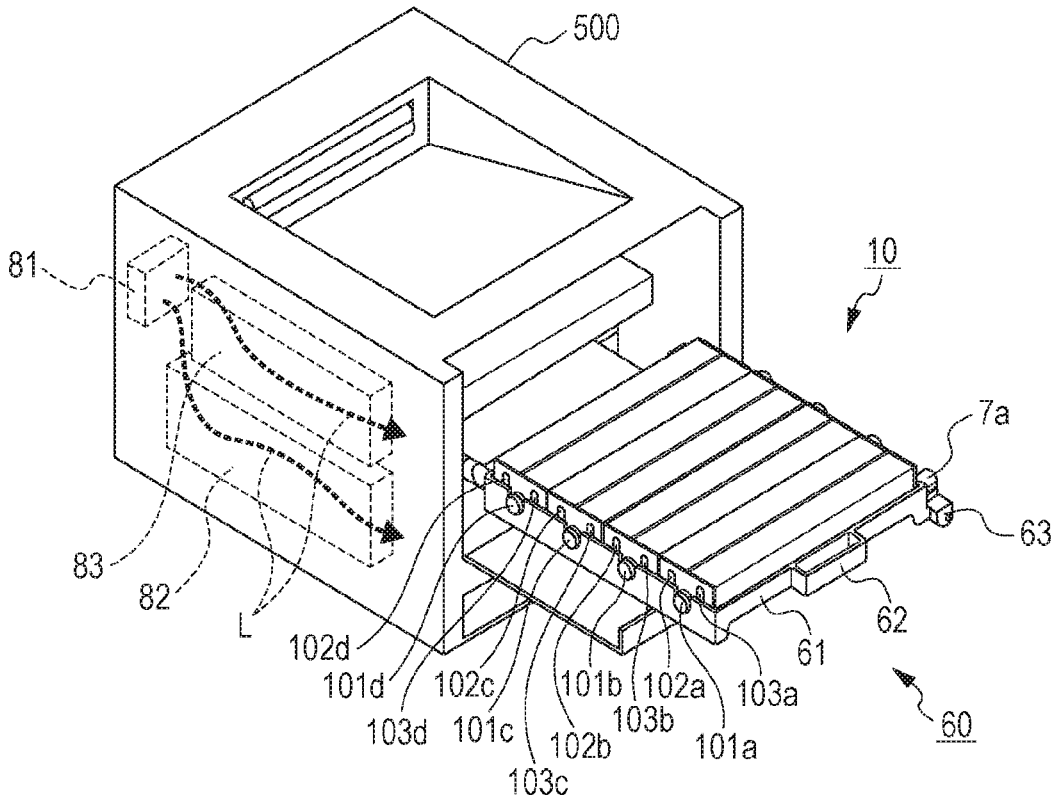
FIG. 6 is a perspective view of an image forming apparatus according to an example third embodiment.

FIG. 6 is an external view of the apparatus main body 500 as viewed in the same direction as FIG. 4C. The moving member 60 illustrated in FIG. 6 is also pulled out of the apparatus main body 500. Referring to FIG. 6, the electrical component unit 83 and the driving unit 82 are disposed on one side of the apparatus main body 500. The electrical component unit 83 is for supplying a developing bias and a charging bias to the cartridge 10, and the driving unit 82 is for transmitting drive to the photosensitive drums 2 of the cartridge 10. In the longitudinal direction of the photosensitive drums 2, the driving unit 82 is disposed on the same side of the apparatus main body 500 as the drive couplings 101, the charging contacts 103, and the developing contacts 102 arranged at an end of the cartridge 10. An air blower 81 is disposed near the electrical component unit 83 and the driving unit 82. The air blower 81 produces the airflow L directed toward the electrical component unit 83 and the driving unit 82 for cooling.

In the longitudinal direction of the photosensitive drums 2, the removed toner conveying unit 63 and the second removed toner outlet 66 are disposed at an end of the moving member 60 opposite the electrical component unit 83, the driving unit 82, and the airflow L on one side of the apparatus main body 500.

In the present embodiment, the airflow L and the object to be cooled by the airflow L are both at the same end opposite the second removed toner outlet 66, in the longitudinal direction of the photosensitive drums 2. This can prevent toner from being scattered through the second removed toner outlet 66 by the airflow L.

Fourth Example Embodiment

The configuration of an example fourth embodiment is the same as that of the first embodiment except that a moving member 600 includes the photosensitive drum 2*a* and the charging member 4*a*.

Figure 7:
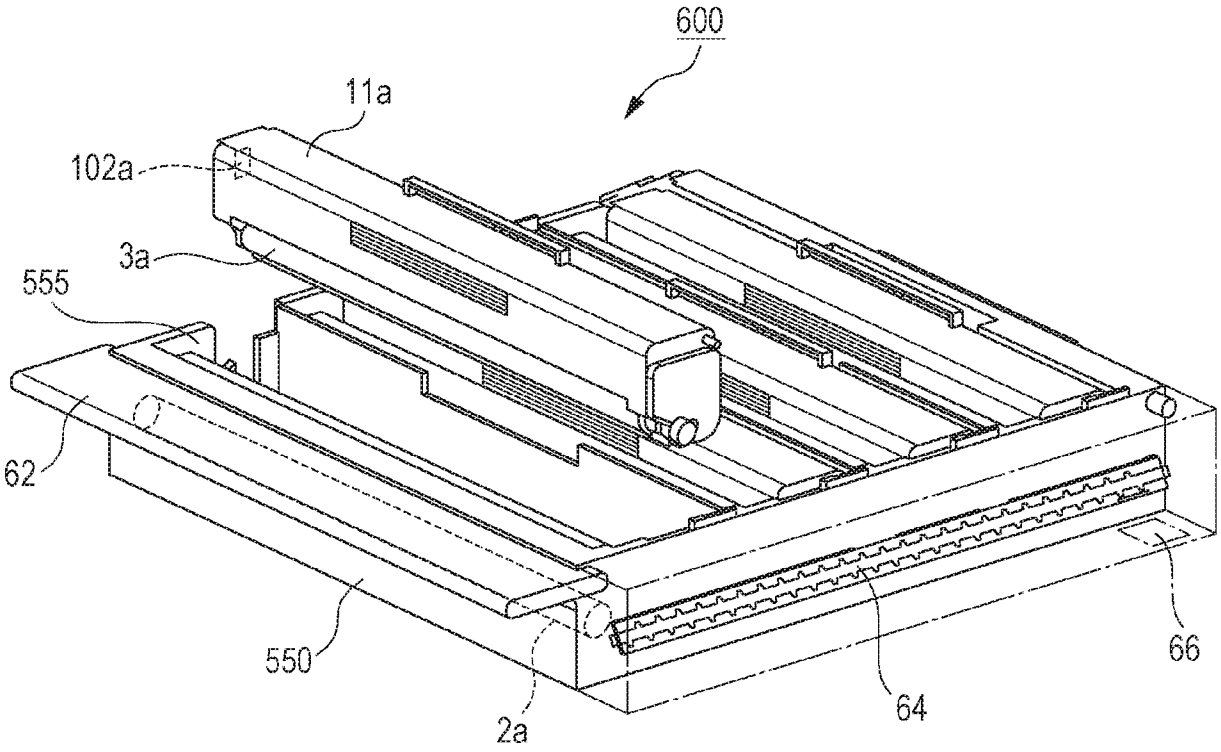
FIG. 7 is a perspective view of a moving member according to an example fourth embodiment.

FIG. 7 is a perspective view of the moving member 600 according to the fourth embodiment. A cartridge (developing cartridge) 11*a* includes the developing member 3*a* and the developing contact 102*a* for receiving power supply from the developing feed portion 202*a* of the apparatus main body 500. The moving member 600 includes the photosensitive drum 2*a*, the charging member 4*a* (not shown) serving as a processing unit configured to act on the photosensitive drum 2*a*, and a frame body 550 configured to rotatably support the photosensitive drum 2*a*. The frame body 550 includes a mount portion 555 configured to allow the cartridge 11*a* to be mounted thereon and removed therefrom. The mount portion 555 is configured to allow the cartridge 11*a* to be mounted thereon in such a manner that in the rotational axis direction of the photosensitive drum 2*a*, the developing contact 102*a* is disposed at an end of the cartridge 11*a* opposite the second removed toner outlet 66. In other words, the mount portion 555 is configured not to allow the cartridge 11*a* to be mounted thereon in such a manner that in the rotational axis direction of the photosensitive drum 2*a*, the developing contact 102*a* is disposed on the same side as the second removed toner outlet 66. The second removed toner outlet 66 is provided with the shutter 67 (not shown) capable of opening and closing.

The cartridge 11*a* described in the present embodiment is one of a plurality of cartridges 11 of the moving member 600. The other cartridges 11 have the same structure as the cartridge 11*a*.

Figure 8:
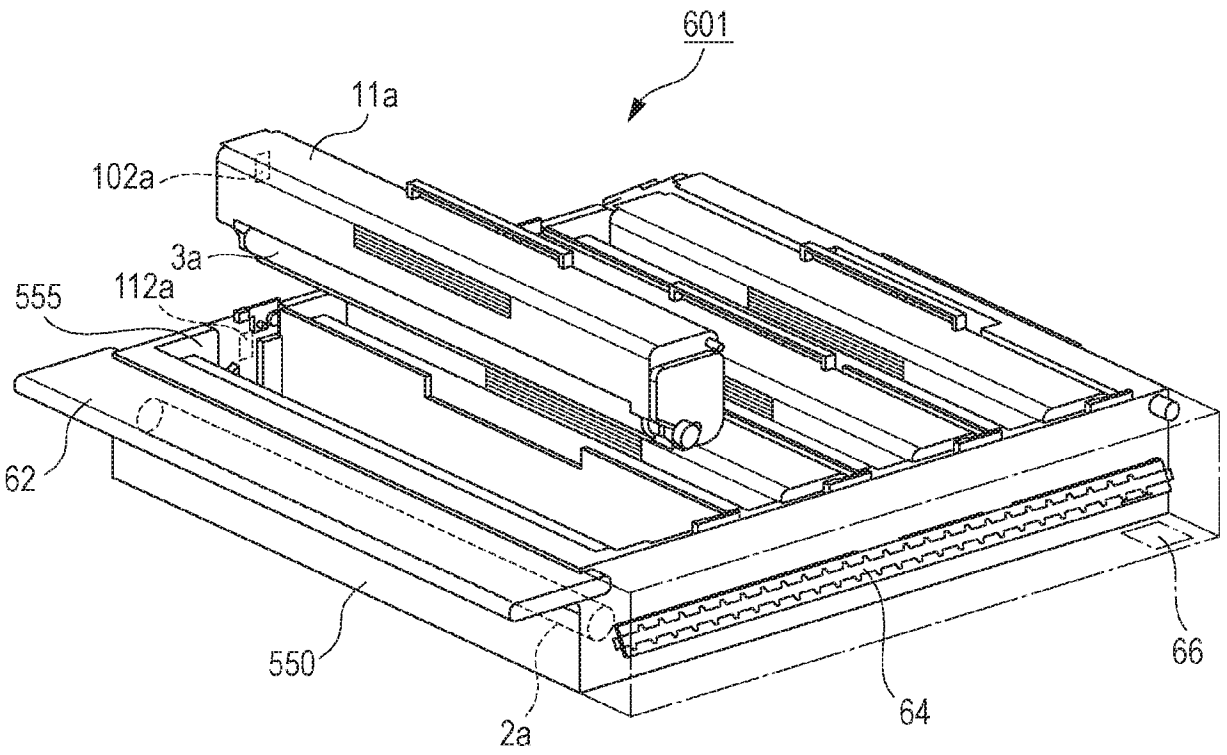
FIG. 8 is a perspective view of a moving member according to a modification of the fourth embodiment.

In the present embodiment, the developing contact 102*a* of the cartridge 11*a* is brought into direct contact with the developing feed portion 202*a* of the apparatus main body 500. As in a modification illustrated in FIG. 8, a moving member 601 may have an intermediate contact 112*a*, which allows the developing contact 102*a* of the cartridge 11*a* to be electrically connected to the developing feed portion 202*a*.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-032597 filed Feb. 26, 2018, which is hereby incorporated by reference herein in its entirety.

What is claimed is:

1. An image forming apparatus comprising:

an apparatus main body; and a moving unit supported by the apparatus main body, the moving unit being movable, with respect to the apparatus main body, between a first position in which the moving unit is inside the apparatus main body and a second position in which at least part of the moving unit is exposed outside the apparatus main body, wherein the moving unit includes a rotatable image bearing member;

a cleaning member configured to clean the image bearing member;

a conveying member configured to convey removed toner in a rotational axis direction of the image bearing member, the removed toner being removed from the image bearing member by the cleaning member;

an outlet through which the removed toner conveyed by the conveying member is discharged to the outside of the moving unit, the outlet being disposed at a first end of the moving unit in the rotational axis direction, the outlet being disposed on an upstream side of the moving unit in a moving direction from the first position to the second position so that the outlet is inside the apparatus main body in a case where the moving unit is moved to a maximum extent in the moving direction when the moving unit is viewed in a direction orthogonal to the moving direction;

a processing unit configured to act on the image bearing member; and an electrical contact through which the processing unit receives power from the apparatus main body, the electrical contact being disposed at a second end of the moving unit opposite to the first end in the rotational axis direction, wherein the apparatus main body includes a container configured to accommodate the removed toner therein, the container having an inlet through which the removed toner discharged from the outlet is received, and the container is disposed outside a moving path of the moving unit between the first position and the second position; and wherein when the moving unit is at the first position, the inlet is connected to the outlet in such a manner as to receive the removed toner, and wherein when the moving unit is at the second position, the inlet is disconnected from the outlet.

2. The image forming apparatus according to claim 1, wherein the moving unit is configured to be moved in a direction crossing the rotational axis direction.

3. The image forming apparatus according to claim 1, wherein the moving unit includes a drive receiving portion configured to receive a driving force for rotationally driving the image bearing member from the apparatus main body, the drive receiving portion being disposed at the second end of the moving unit.

4. A moving unit used in an image forming apparatus including an apparatus main body, the apparatus main body including a container configured to accommodate removed toner therein, the moving unit comprising:

a frame body configured to be supported by the apparatus main body so that the moving unit is movable, with respect to the apparatus main body, between a first position in which the moving unit is inside the apparatus main body and a second position in which at least part of the moving unit is exposed outside the apparatus main body;

an image bearing member supported by the frame body so that the image bearing member is rotatable about a rotational axis extending in a direction crossing a direction in which the moving unit is moved;

a cleaning member configured to clean the image bearing member;

a conveying member configured to convey removed toner in a rotational axis direction of the image bearing member, the removed toner being removed from the image bearing member by the cleaning member;

an outlet configured to discharge the removed toner conveyed by the conveying member toward the container, the outlet being disposed at a first end of the moving unit in the rotational axis direction, the outlet being disposed on an upstream side of the moving unit in a moving direction from the first position to the second position so that the outlet is inside the apparatus main body in a case where the moving unit is moved to a maximum extent in the moving direction when the moving unit is viewed in a direction orthogonal to the moving direction;

a shutter configured to be able to open and close the outlet;

a processing unit configured to act on the image bearing member; and an electrical contact through which the processing unit receives power from the apparatus main body, the electrical contact being disposed at a second end of the moving unit opposite to the first end in the rotational axis direction.

5. A moving unit used in an image forming apparatus including an apparatus main body and a developing cartridge having a developing member, the apparatus main body including a container configured to accommodate removed toner therein, the moving unit comprising:

a frame body configured to be supported by the apparatus main body so that the moving unit is movable, with respect to the apparatus main body, between a first position in which the moving unit is inside the apparatus main body and a second position in which at least part of the moving unit is exposed outside the apparatus main body, the frame body including a mount portion to which the developing cartridge is detachably mountable;

an image bearing member rotatably supported by the frame body;

a cleaning member configured to clean the image bearing member;

a conveying member configured to convey removed toner in a rotational axis direction of the image bearing member, the removed toner being removed from the image bearing member by the cleaning member;

an outlet configured to discharge the removed toner conveyed by the conveying member toward the container, the outlet being disposed at a first end of the frame body in the rotational axis direction, the outlet being disposed on an upstream side of the moving unit in a moving direction from the first position to the second position so that the outlet is inside the apparatus main body in a case where the moving unit is moved to a maximum extent in the moving direction when the moving unit is viewed in a direction orthogonal to the moving direction;

a shutter configured to be able to open and close the outlet; and an electrical contact through which the developing member receives power from the apparatus main body when the developing cartridge is mounted on the mount portion, the electrical contact being disposed at a second end of the frame body opposite to the first end of the frame in the rotational axis direction.

6. A moving unit used in an image forming apparatus including an apparatus main body and a developing cartridge having a developing member, the apparatus main body including a container configured to accommodate removed toner therein, the developing cartridge having an electrical contact through which the developing member receives power from the apparatus main body, the moving unit comprising:

a frame body configured to be supported by the apparatus main body so that the moving unit is movable, with respect to the apparatus main body, between a first position in which the moving unit is inside the apparatus main body and a second position in which at least part of the moving unit is exposed outside the apparatus main body, the frame body including a mount portion to which the developing cartridge is detachably mountable;

an image bearing member supported by the frame body so that the image bearing member is rotatable about a rotational axis extending in a direction crossing a direction in which the moving unit moves;

a cleaning member configured to clean the image bearing member;

a conveying member configured to convey removed toner in a rotational axis direction of the image bearing member, the removed toner being removed from the image bearing member by the cleaning member;

an outlet configured to discharge the removed toner conveyed by the conveying member toward the container, the outlet being disposed at a first end of the moving unit in the rotational axis direction, the outlet being disposed on an upstream side of the moving unit in a moving direction from the first position to the second position so that the outlet is inside the apparatus main body when the moving unit is moved to a maximum extent in the moving direction in a case where the moving unit is viewed in a direction orthogonal to the moving direction; and a shutter configured to be able to open and close the outlet, wherein the mount portion is configured so that the developing cartridge is detachably mounted thereon in such a manner that the electrical contact of the developing cartridge is on a side of a second end of the moving unit opposite to the first end of the moving unit in the rotational axis direction.

* * * * *